US007189165B2

(12) United States Patent
Yamamoto

(10) Patent No.: US 7,189,165 B2
(45) Date of Patent: Mar. 13, 2007

(54) GOLF CLUB HEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 198 days.

(21) Appl. No.: 11/042,048

(22) Filed: Jan. 26, 2005

(65) Prior Publication Data

US 2005/0209022 A1 Sep. 22, 2005

(30) Foreign Application Priority Data

Mar. 18, 2004 (JP) ..... 2004-078811

(51) Int. Cl.
*A63B 53/04* (2006.01)

(52) U.S. Cl. ..... 473/248; 473/347; 473/345

(58) Field of Classification Search ..... 473/324–350
See application file for complete search history.

(56) References Cited

U.S. PATENT DOCUMENTS 5,419,231 A * 5/1995 Earle et al. ..... 87/1
5,425,538 A * 6/1995 Vincent et al. ..... 473/342
5,447,311 A * 9/1995 Viollaz et al. ..... 473/342
6,248,025 B1 * 6/2001 Murphy et al. ..... 473/324
6,849,003 B2 * 2/2005 Kumamoto ..... 473/305
6,969,326 B2 * 11/2005 De Shiell et al. ..... 473/345
2003/0134692 A1 7/2003 Nakahara et al.
2004/0053705 A1 * 3/2004 Kumamoto ..... 473/345

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head comprises: a hollow main body made of at least one metal material and provided in at least one of a crown portion and a sole portion of the head with an opening; and an FRP part covering said opening and made of at least one resinous material reinforced with fibers, wherein the fibers include: longitudinal fibers oriented in a direction substantially parallel to the front-back direction of the head; and traversal fibers oriented in a direction substantially perpendicular to the front-back direction, and the longitudinal fibers are less than the traversal fibers with respect to a total weight of fibers in a unit area and/or a total of tensile elastic moduli of fibers in a unit area.

7 Claims, 12 Drawing Sheets

Ref.1

Ref.2

Exs.1-3,5-7

GOLF CLUB HEAD

BACKGROUND OF THE INVENTION

The present invention relates to a hybrid golf club head composed of a metal part and an FRP part, more particularly to an improvement in a FRP part capable of improving the rebound performance.

Nowadays, the trend of wood-type club heads is toward a large head volume. In a large-sized wood-type club head, as the weight of the head is limited, the thickness is inevitably decreased as the volume is increased. Especially, the thickness of the crown portion becomes very small. In the face portion, on the other hand, for the purpose of increasing the flexure of the face portion at impact and thereby improving the rebound performance, it is widely employed to decrease the thickness.

However, even if the thickness of the face portion is decreased optimally, the rebound performance is not necessarily improved.

Therefore, the inventor made a study on the relationship between the rebound performance and flexure of the face portion at impact, and it was found that, by using a specifically designed FRP part in the crown portion and sole portion which support the upper and lower edges of the face portion, the apparent flexure of the face portion at impact can be increased and further the apparent resilience of the face portion can be increased. As a result, the rebound performance can be improved.

SUMMARY OF THE INVENTION

It is therefore, an object of the present invention to provide a golf club head of which rebound performance is improved by using a FRP part which can provide a support for the face portion which support can increase the apparent flexure at impact and apparent resilience of the face portion.

According to the present invention, a golf club head comprises: a hollow main body made of at least one metal material and provided in at least one of a crown portion and a sole portion of the head with an opening; and an FRP part covering said opening and made of at least one resinous material reinforced with fibers, the fibers including longitudinal fibers oriented in a direction substantially parallel to the front-back direction of the head, and traversal fibers oriented in a direction substantially perpendicular to the front-back direction, wherein the longitudinal fibers are less than the traversal fibers with respect to at least one of: (1) a total weight of fibers in a unit area; (2) a total of tensile elastic moduli of fibers in a unit area; and (3) a product of a total weight of fibers in a unit area and an average tensile elastic moduli of the fibers.

DESCRIPTION OF THE PREFERRED EMBODIMENTS

Figure 1:
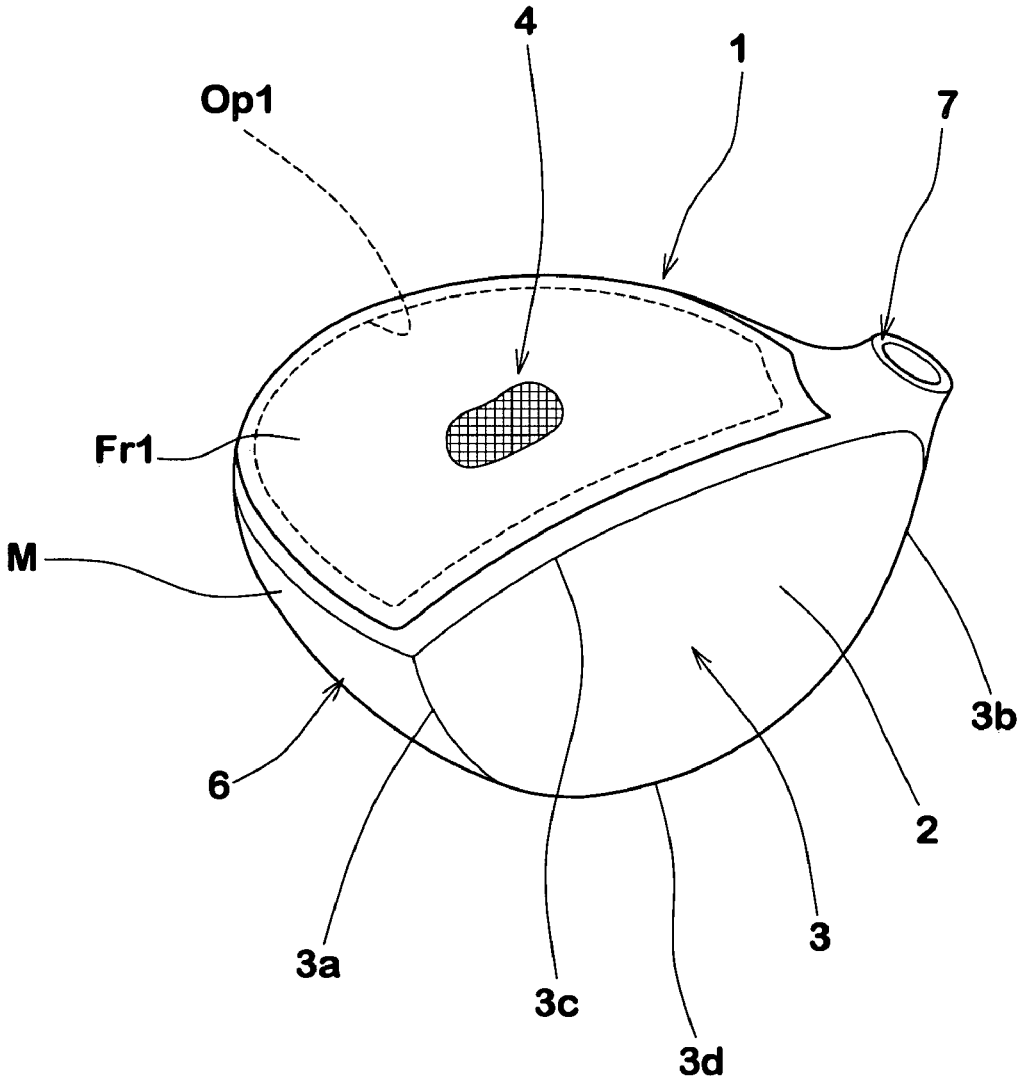
FIG. 1 is a perspective view of a wood-type golf club head according to the present invention.

Embodiments of the present invention will now be described in detail in conjunction with the accompanying drawings.

In the drawings, club head 1 according to the present invention comprises: a face portion 3 whose front face defines a club face 2 for striking a ball; a crown portion 4 defining a top surface of the head intersecting the club face 2 at the upper edge 3*c* thereof; a sole portion 5 defining a bottom surface of the head intersecting the club face 2 at the lower edge 3*d* thereof; a side portion 6 between the crown portion 4 and sole portion 5 which extends from a toe-side edge 3*a* to a heel-side edge 3*b* of the club face 2 through the back face of the club head; and a neck portion 7 at the heel side end of the crown to be attached to an end of a club shaft (not shown). The club head 1 is a relatively large-sized wood-type head (#1 driver) having a closed cavity (i).

The volume of the head is not less than 200 cc, but not more than 500 cc. Preferably, the volume is set in the range of more than 300 cc, more preferably more than 380 cc. However, the upper limit is 470 cc if comply with the rules of the R&A or USGA. The horizontal moment of inertia of the head around a vertical axis passing through the center G of gravity of the head under its standard state is preferably set in the range of not less than 2000, more preferably more than 3000, still more preferably more than 3500 (g·sq.cm). Further, the vertical moment of inertia around a horizontal axis extending in the toe-heel direction of the head passing through the center G of gravity under the standard state is preferably set in the range of not less than 1500, more preferably 2000 (g·sq.cm).

Here, the standard state is a state of the golf club head which is set on a horizontal plane HP to satisfy its lie angle and loft angle (real loft angle). The toe-heel direction is a direction perpendicular to a front-back direction of the head. The front-back direction is a direction along a normal line N drawn to the club face 2 from the center G of gravity. The toe-heel direction and front-back direction are parallel to the horizontal plane HP.

According to the invention, the head 1 is composed of a hollow main body M provided with an opening Op1, Op2, and an FRP part Fr1, Fr2 (generically "FRP part Fr") covering the opening Op1, Op2 (generically "opening Op").

The FRP part Fr is made of at least one kind of resinous material reinforced with fibers embedded therein.

As to the resinous material, various resins, for example, thermosetting resins such as epoxy resin and phenol resin, thermoplastic resins such as nylon resin and polycarbonate resin, and the like can be used.

As to the reinforcing fibers, various fibers, for example, inorganic fibers such as carbon fibers and glass fibers, organic fibers such as aramid fibers and poly-p-phenylenebenzobisoxazole (PBO) fibers, metal fibers such as amorphous metal fibers and titanium fibers, and the like can be used.

Preferably carbon fibers are used as the tensile strength is very high for the relatively small specific gravity, and a thermosetting resin is used in view of the excellent adhesive property, molding time, cost and the like.

The reinforcing fibers include:

longitudinal fibers which are, in the crown or sole portion, oriented in a direction substantially parallel to the front-back direction of the head; and traversal fibers which are, in the same portion, oriented in a direction substantially perpendicular to the front-back direction.

Given that Gl is the product of the tensile modulus E (Gpa) and the weight (gram) of the longitudinal fibers (if two or more kinds of fibers having different moduli are used as the longitudinal fibers, the sum total of the products of the respective kinds of fibers is used instead), and Gt is the product of the tensile modulus E (Gpa) and the weight (gram) of the traversal fibers (if two or more kinds of fibers having different moduli are used as the traversal fibers, the sum total of the products of the respective kinds of fibers is used instead), in order to improve the rebound performance, the product Gl is decreased to under the product Gt. Preferably, the ratio Gl/Gt is set in the range of not more than 0.9, more preferably less than 0.8, still more preferably less than 0.6, but not less than 0.1, more preferably more than 0.2, still more preferably more than 0.3. If the ratio Gl/Gt is less than 0.1, the durability is liable to deteriorate.

If the longitudinal fibers and the traversal fibers are almost same moduli, the ratio of the total weight of the longitudinal fibers to that of the traversal fibers can be set in the same range as the ratio Gl/Gt for the same reason.

This will become more apparent from the undermentioned method of making the golf club head.

The main body M is made of at least one kind of metal material. For example, stainless steels, maraging steels, pure titanium, titanium alloys, aluminum alloys, magnesium alloys amorphous alloys and the like can be used. Especially, metal materials having a large specific tensile strength such as titanium alloys, aluminum alloys and magnesium alloys are preferred.

It is possible to make the main body M by assembling/welding two or more metal parts each formed by a suitable method, e.g. casting, forging, pressing, rolling and the like. But, it is preferable that the main body M is formed as one integral part by casting or the like.

In the following embodiments, the main body M is made of one kind of metal material, a titanium alloy Ti-6Al-4V, and formed by precision casting. In order to increase the flexure of the face portion 3 at impact, the maximum thickness of the face portion 3 is limited in a range of from 1.8 to 3.0 mm, preferably 2.1 to 2.9 mm, more preferably 2.3 to 2.9 mm. To further increase the flexure at impact without decreasing the durability and strength, the face portion 3 is preferably provided with a thinner peripheral region having a minimum thickness encircling a thicker central region in which the above-mentioned maximum thickness occurs. The thicker central region includes the centroid of the club face. The difference between the maximum and minimum is preferably in the range of from 0.1 to 1.5 mm.

Figure 5A:
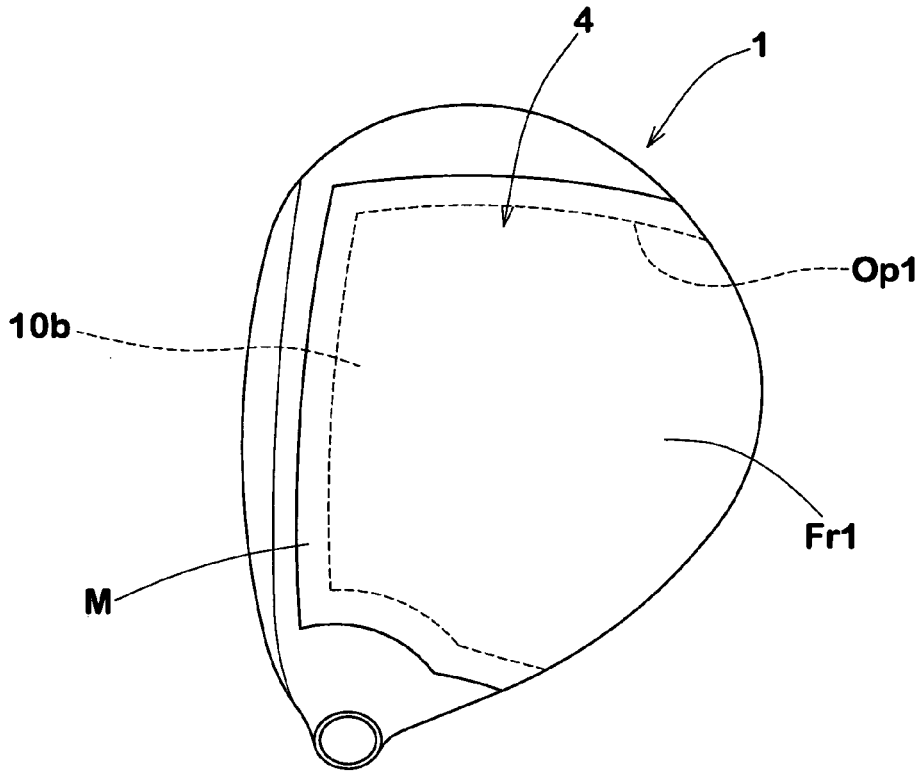
FIGS. 5(*a*) and 5(*b*) are a top view and a rear view of a modification of the golf club head shown in FIGS. 1–4.
Figure 5B:
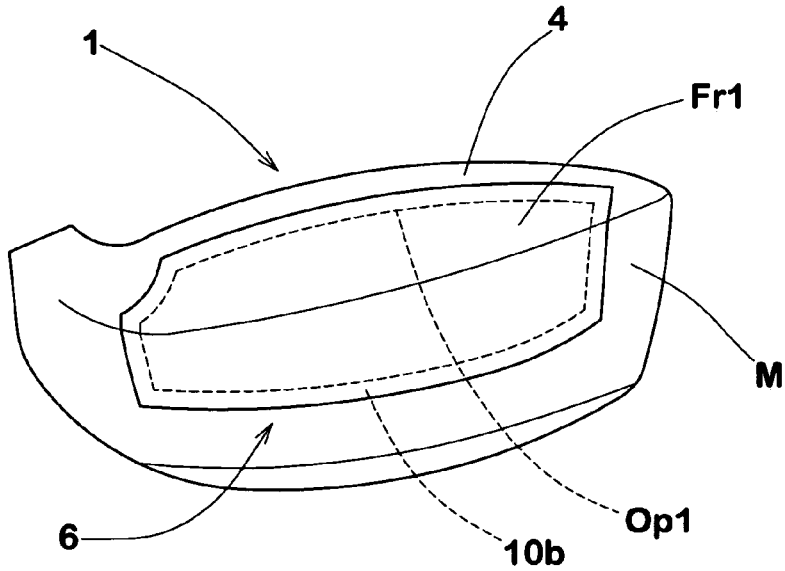
Figure 6:
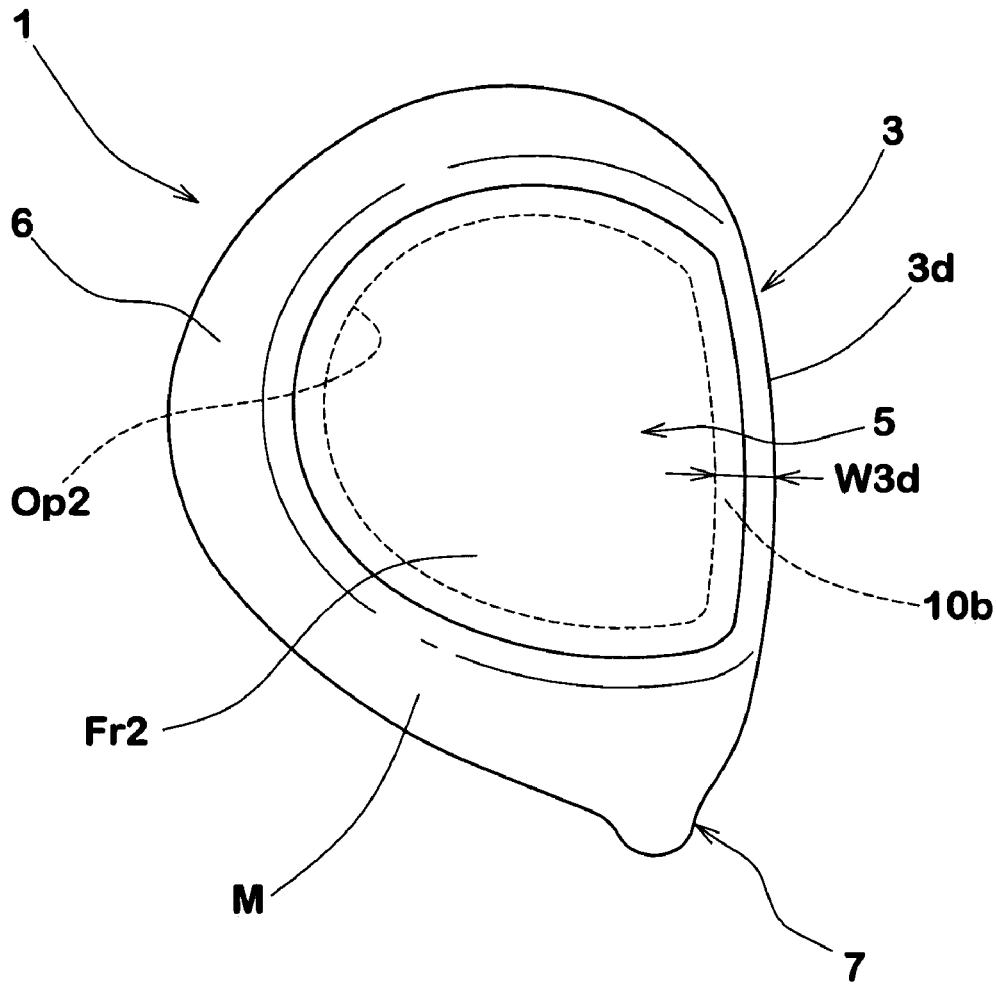
FIG. 6 is a bottom view a golf club head according to the present invention.

In FIGS. 1–4, the opening Op1 is provided within the crown portion 4. But, as shown in FIGS. 5(*a*) and 5(*b*), the opening Op1 in the crown portion 4 can be extended to the back face. In FIG. 6, the opening Op2 is formed within the sole portion 5, but the opening Op2 in the sole portion 5 may be extended to the back face similarly to the opening Op1 shown in FIG. 5(*b*).

Figure 2:
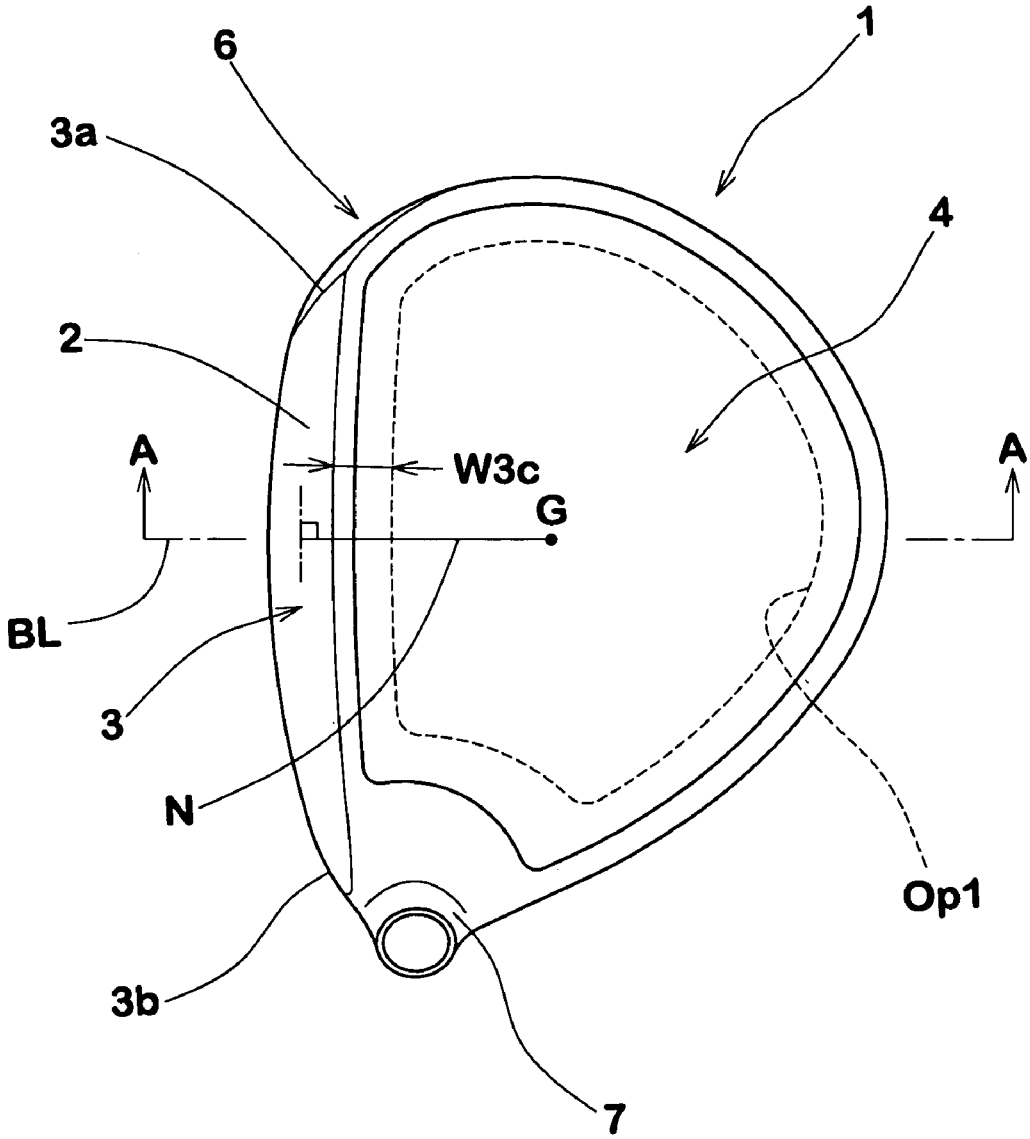
FIG. 2 is a top view thereof.

In the embodiment shown in FIGS. 1 to 4, the main body M includes the above-mentioned face portion 3, sole portion 5, side portion 6 and neck portion 7. As to the crown portion 4, only a peripheral region 10 or edge area is included because the opening Op1 which is slightly smaller than the crown portion 4 is formed within the crown portion. Thus, when viewed from the top as shown in FIG. 2, the center G of gravity of the head is included in the opening Op1 at the almost center thereof. In this embodiment, the almost entirety of the crown portion 4 is formed from the FRP part Fr1.

In the embodiment shown in FIGS. 5(*a*) and 5(*b*), as the opening Op1 extends backwards into the side portion 6, the main body M includes the face portion 3, sole portion 5 and neck portion 7. As to the crown portion 4, only its edge area 10 on the toe-side, heel-side and clubface-side is included. In this case too, the almost entirety of the crown portion 4 is formed from the FRP part Fr1.

In FIG. 6, as the opening Op2 is formed within the sole portion 5, only a peripheral region 10 of the sole portion 5 is included in the main body M. In this case, the opening Op1 may also be formed in the crown portion as in the former examples. But in this embodiment, the opening Op1 is not formed. Thus, the main body M further includes the face portion 3, crown portion 4, side portion 6 and neck portion 7.

If the area of the opening Op is too small, or more specifically the percentage of the area of the opening Op in the crown portion or sole portion which is covered with the FRP part Fr is too small, then the improvement in the rebound performance due to the improved resilience of the FRP part Fr and the reduction in the head weight may not be achieved. Therefore, it is preferable that the ratio (S1/S) of the area S1 of the opening Op1 and the area S encircled by the outline of the head 1 when viewed from the top as shown in FIG. 2, is set in the range of not less than 0.5, more preferably more than 0.6, but not more than 0.9, more preferably less than 0.8.

In the sole portion too, it is preferable that the ratio (S2/S) of the area S2 of the opening Op2 in the sole portion 5 and the area S encircled by the outline of the head 1 when viewed from the bottom as shown in FIG. 6, is set in the range of not less than 0.5, more preferably more than 0.6, but not more than 0.9, more preferably less than 0.8.

These limitations are also applied to the case where the opening Op1 or Op2 is extended to the back face as explained above in connection with FIG. 5(*b*).

In any case, the front edge of the opening Op extends almost parallel to the adjacent upper or lower edge 3*c*, 3*d* of the face portion, and the width W3*c*, W3*d* between the front edge and the adjacent edge 3*c*, 3*d* is less then 20 mm, preferably less than 15 mm, more preferably less than 10 mm. such almost parallel part preferably has a length of more than 50% of the edge (upper or lower) of the face portion, and is substantially centered on the center of the club face when viewed from the top or bottom.

* Flush Joint Portion

As the peripheral portion of the FRP part Fr is overlap jointed with the surrounding portion 10 around the opening Op, a flush joint portion 10*b* is formed along the edge of the opening Op. The flush joint portion 10*b* has a stepped face to contact and support the inner surface of the peripheral portion of the FRP part Fr with the outer surface thereof being flush with the outer surface 10*a* of the surrounding portion 10.

If only the adhesive strength between these surfaces is considered, the width Wa of the flush joint portion 10*b* is set in the range of more than 10 mm, but less than 20 mm, preferably less than 15 mm, when measured perpendicularly to the edge of the opening Op. At any rate, the width Wa have to be at least 5 mm. Even if the thickness of the flush joint portion 10*b* is very thin, the width Wa is at most 30 mm.

The flush joint portion 10*b* in this example is formed continuously along the entire length L of the edge of the opening Op. But it is also possible to form the flush joint portion 10*b* discontinuously at appropriate intervals. In any case, the total length of the flush joint portion 10*b* satisfying the above minimum limitation to the width Wa is preferably set in the range of not less than 50%, preferably more than 60%, more preferably more than 70% of the length L to secure a sufficient bonding area between the main body M and FRP part Fr and thereby to obtain a sufficient adhesive strength.

Accordingly, the FRP part Fr is shaped to adapt to the shape of the opening including the flush joint portion 10*b*.

In the FRP part Fr, the above-mentioned reinforcing fibers have a layered structure which comprises a plurality of plies 12A and 12B each made of unidirectionally oriented reinforcing fibers (f) and optionally a ply 12C of woven or bidirectionally oriented reinforcing fibers (f).

In the crown portion and sole portion, the fibers (f) in each ply 12A extend substantially in the front-back direction of the head (namely, the longitudinal fibers), and the fibers (f) in each ply 12B extend substantially in the toe-heel direction perpendicular to the front-back direction (namely, the traversal fibers).

The fibers (f) in the bidirectional ply 12C are woven square and laid at substantially 45 degrees with respect to the front-back direction (hereinafter, bias fibers).

In case of the plies 12A and 12B, the fiber orientation directions may permit variations of 10 degrees at the maximum (preferably 5 degrees). In other words, the longitudinal fibers (f) in the ply 12A are orientated towards a direction at an angle of not more than 10 preferably 5 degrees with respect to the front-back direction. The traversal fibers (f) in the ply 12B are orientated towards a direction at an angle of not more than 10 preferably 5 degrees with respect to the toe-heel back direction (namely, from 80 to 100 degrees, preferably 85 to 95 degrees with respect to the front-back direction).

In case of the ply 12C, the fiber orientation direction may permit a slightly larger variation, and the bias fibers (f) therein extending in one direction (thus others extend perpendicular thereto) are oriented towards a direction at an angle of more than 30 degrees, preferably more than 40 degrees, but less than 60 degrees, preferably less than 50 degrees with respect to the front-back direction.

The cross ply 12C is usually disposed outside the unidirectional plies 12A and 12B as the outermost ply. But it can be disposed inside the unidirectional plies 12A and 12B as the innermost ply. Further, it is possible to dispose the ply 12C on each side as the outermost ply and the innermost ply.

Figure 7:
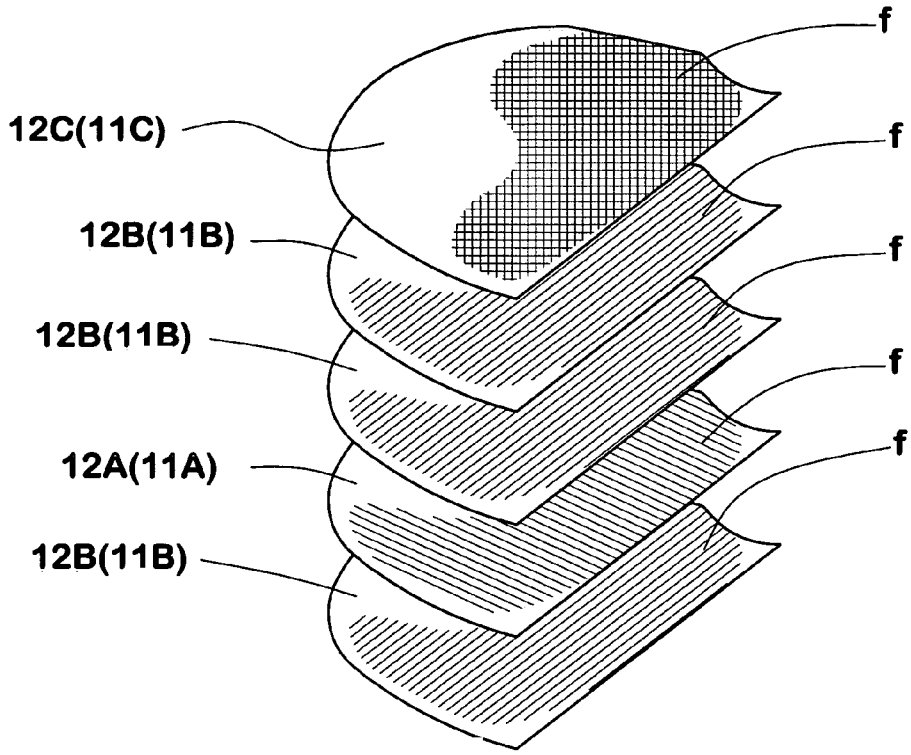
FIG. 7 is a perspective view showing an arrangement of the reinforcing fiber layers.

As to the arrangement of the unidirectional plies 12A and 12B, an example is shown in FIG. 7. In this example, the number of the unidirectional ply or plies 12A is less than the number of the unidirectional ply or plies 12B. This arrangement can be used when the difference between the ply 12A and ply 12B is small in respect of the fibers' properties such as modulus and the density of the fibers embedded in the ply (the density corresponds to the fiber areal weight of the undermentioned prepreg).

Figure 8:
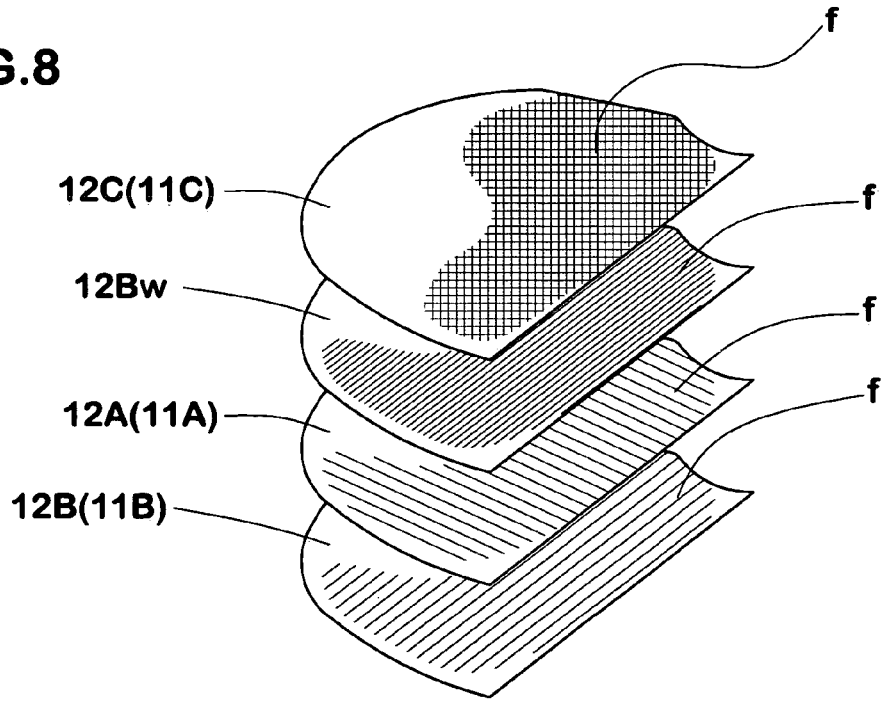
FIG. 8 is a perspective view showing another example of the arrangement of the reinforcing fiber layers.

FIG. 8 shows a further example wherein, unlike the FIG. 7 example, an unidirectional ply 12BW is increased for example doubled in the fiber density when compared with a ply 12B. Thus, on the outside of the ply 12A, one ply 12BW is used although two plies 12B are used in the FIG. 7 example. In this example too, the number of the unidirectional ply or plies 12A is still less than the number of the unidirectional ply or plies 12B (12BW). However, if the difference in the fibers' properties and/or the density is large enough, it may be possible to use the same number of the plies 12A and 12B.

In either case, as shown in FIGS. 7 and 8, it is preferable for the durability that the longitudinal fiber ply 12A is sandwiched between the traversal or bias fiber plies 12B, 12BW, 12C.

If the tensile modulus E of elasticity of the reinforcing fiber is too small, it is difficult to provide the FRP part Fr with the necessary rigidity. As a result, the resilience can not be improved and the durability tends to decrease. If the tensile modulus of elasticity is too large, the resilience is again not improved, and contrary to expectation the tensile strength of the FRP part Fr tends to decrease.

Therefore, the tensile modulus E of elasticity of the reinforcing fiber is preferably set in the range of not less than 50 GPa, more preferably more than 100 GPa, still more preferably more than 150 GPa, yet still more preferably more than 200 GPa, but not more than 450 GPa, more preferably less than 350 GPa, when measured according to the testing method prescribed in the Japanese Industrial standard R 7601.

If k(a plural number) kinds of fibers fi (i=1 to k) having different moduli are used in a ply (or undermentioned prepreg piece) in combination, the average of the tensile moduli weighted by the fiber weights according to the following equation is used instead.

$$\Sigma(Ei \times Vi)/\Sigma Vi$$

wherein: Ei is the tensile modulus of elasticity of fiber fi; and Vi is the gross weight of the fiber fi. For example, two kinds of fibers f1 and f2 are used in a layer, the average of the tensile moduli is: $E1\Sigma V1/(V1+V2)+E2\times V2/(V1+V2)$.

In case that the above-mentioned difference between the ply 12A and ply 12B is very small or zero, the difference of the number of the plies 12B from the number of the ply(ies) 12A is set in the range of 1 to 4, preferably 2 to 4, more preferably 2 to 3. when the fibers in the plies 12A and 12B are carbon fibers having a modulus in the above-mentioned range, it is preferable that the total number of the plies 12A and 12B is set in the range of not less than 4, more preferably not less than 5, but not more than 8, more preferably not more than 7. For example in order to decrease the difference in number between the plies 12A and 12B, the modulus of elasticity of the longitudinal fiber ply 12A can be decreased to under that of the traversal fiber ply 12B. In this case too, the lower limit is 50 GPa. The upper limit is about 245 GPa, preferably 150 GPa, more preferably 100 GPa.

To decrease the shearing stress between the adjacent plies 12A and 12B, the ratio of the tensile modulus of the fiber in the ply 12A to that of the ply 12B is at least 0.50. Preferably, this ratio is set to be more than 0.60, more preferably more than 0.70. However, to derive the effect of decreasing the modulus, the ratio is at most 0.95, preferably 0.90, more preferably 0.85. Incidentally, when a plurality of plies 12A are used, all of them can be decreased in the modulus. Further, one of or some of the plies 12A can be decreased instead.

The FRP part Fr having the above-mentioned layered structure can be manufactured by using prepreg pieces 11. As well known in the art, the prepreg is sheet-form fiber impregnated with resin.

Figure 9A:
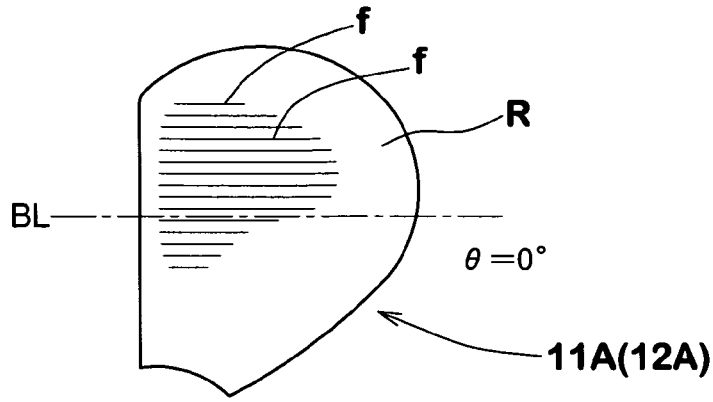
FIGS. 9(*a*), 9(*b*) and 9(*c*) are plan views showing three different prepreg pieces made from two types of prepregs which are utilized for making the FRP part.
Figure 9B:
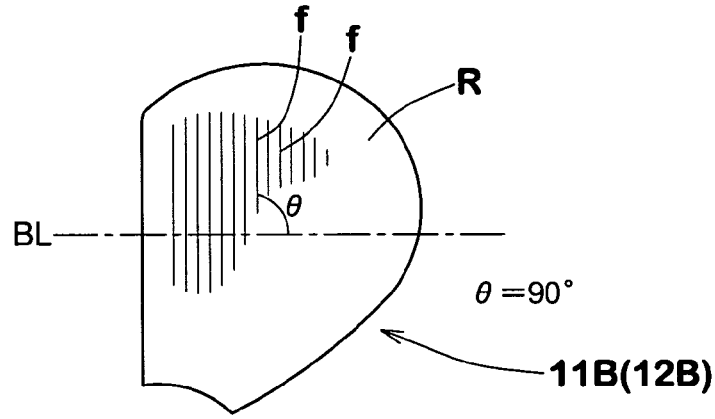
Figure 9C:
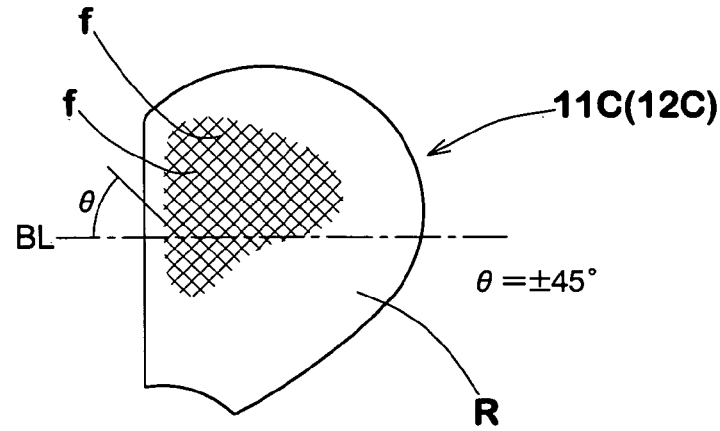

FIG. 9(*a*) shows a prepreg piece 11A used to form the above-mentioned longitudinal fiber ply 12A whose fibers (f) are unidirectionally oriented in the front-back direction. FIG. 9(*b*) shows a prepreg piece 11B used to form the traversal fiber ply 12B whose fibers (f) are unidirectionally oriented in the toe-heel direction. FIG. 9(*c*) shows a prepreg piece 11C used to form the ply 12C whose fibers (f) are woven square and bidirectionally or orthogonally oriented in 45 degree directions with respect to the front-back direction. Thus, by arranging these prepreg pieces (11A, 11B, 11C) in a predetermined specific order, the raw FRP part P(Fr) can be manufactured.

In each prepreg piece, the fiber areal weight "FAW" (g/sq.m) is set in the range of from 20 to 300. Preferably the FAW is more than 30, more preferably more than 40, still more preferably more than 55, but less than 200, more preferably less than 150, still more preferably less than 125.

If the FAW is more than 300, the molding becomes difficult and the percent defective tends to increase. Also the FAW lass than 20 is not preferable for the productivity and cost.

Figure 4:
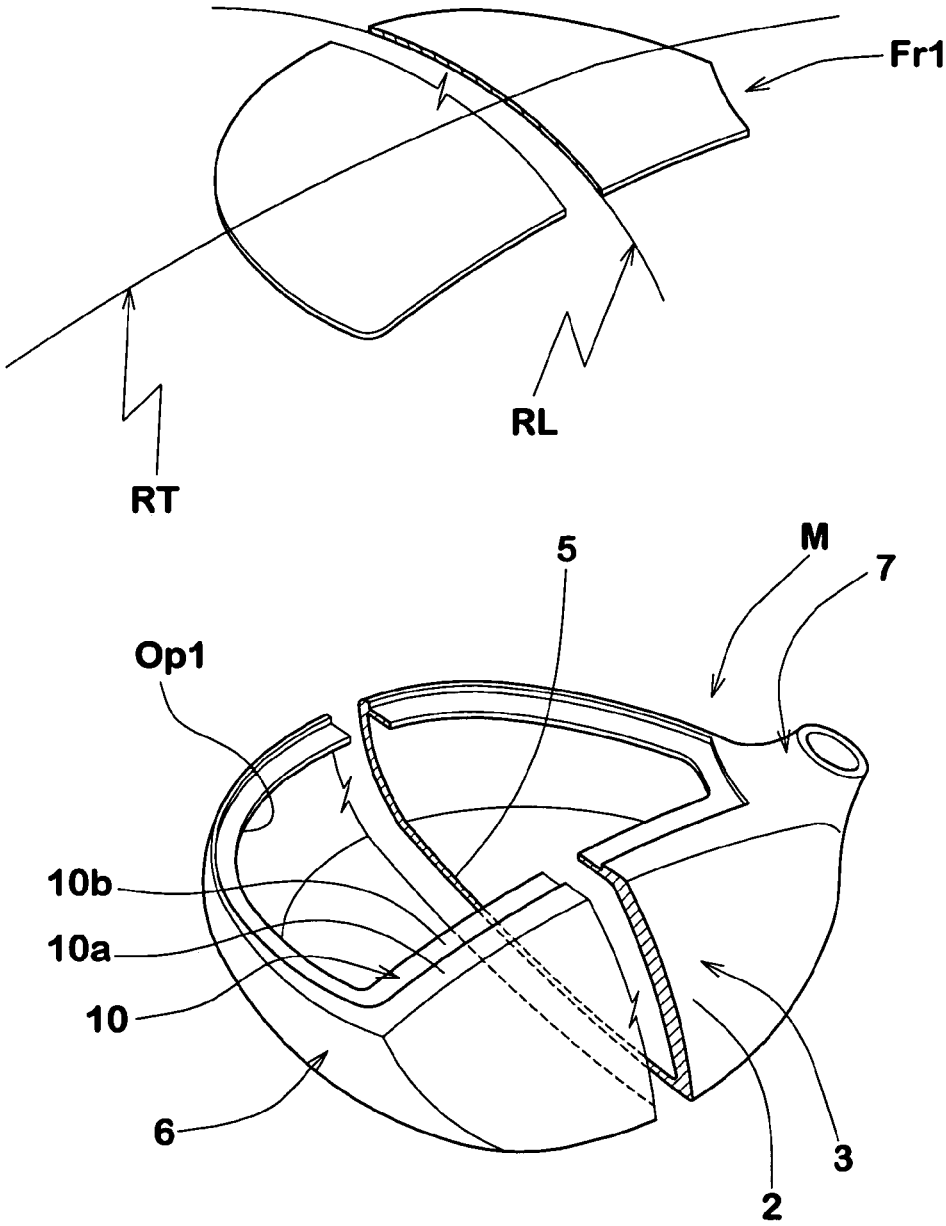
FIG. 4 is an exploded perspective view showing a FRP crown plate and a hollow main body.

For example, in case of FIG. 7, by laying the prepreg pieces 11B, 11A, 11B, 11B and 11C one on top of another in this order, the FRP part Fr1 shown in FIG. 4 can be manufactured. In this example, the prepreg pieces 11A and 11B are made from the same prepreg sheet by using a trimming die for example. Accordingly, the prepreg pieces 11A and 11B are the same in respect of the matrix resin, the material and modulus of the fibers and the fiber areal weight.

Before laying the prepreg pieces (11A, 11B, 11C) into one, the prepreg pieces can be formed into the identical shapes accommodated to the shape of the opening including the flush joint portion. However, it is also possible that, by laying (unidirectional and optional woven) prepregs one on top of another to satisfy the relationship of the fiber orientations in the finished FRP part Fr, a broader sheet of laminated prepreg is first manufactured and then the raw FRP part P(Fr) is cut out therefrom by using a trimming die for example.

As explained above, the ratio Gl/Gt is set in a specific range. To achieve this easily, the fiber areal weight FAW (g/sq.m) of prepreg is used as explained hereunder.

When "G" is defined for each prepreg piece as the product of the fiber areal weight FAW (g/sq.m) and the tensile modulus E (Gpa) of elasticity of the fibers therein (when plural kinds of fibers having different moduli are used, the average modulus obtained as above is used), the sum total GL of the "G" of all the prepreg piece(s) 11A is preferably set in the range of not less than 10,000, more preferably more then 15,000, still more preferably more then 17,000, but not more than to 40,000, more preferably less then 35,000, still more preferably less then 30,000.

On the other hand, the sum total GT of the "G" of all the prepreg pieces 11B is preferably set in the range of not less than 20,000, more preferably more then 30,000, still more preferably more then 34,000, but not more than to 150,000, more preferably less then 100,000, still more preferably less then 90,000.

The ratio GL/GT is set in the range of not more than 0.9, preferably less than 0.8 more preferably less than 0.6, but not less than 0.1, preferably more than 0.2, more preferably more than 0.3.

If the sum total GL is less than 10,000 and/or the sum total GT is less than 20,000, then it becomes difficult to provide necessary durability. If the sum total GL is more than 40,000 and/or the sum total GT is more than 150,000, then it is difficult to improve the rebound performance. If the ratio GL/GT is less than 0.1, the durability is liable to deteriorate.

Such a raw FRP part P(Fr) is cured in a mold 20 by applying heat and pressure.

When the FRP part is cured separately from the main body M, the finished cured FRP part Fr is fixed to the flush joint portion 10*b* by means of an adhesive agent or the like.

However, it is also possible to carry out the curing and fixing at the same time by putting the raw FRP part P(Fr) in a mold 20 together with the main body M. For example, the mold 20 is a split mold comprises an upper piece 20*a* and a lower piece 20*b*.

To increase the adhesion between the raw FRP part P(Fr) and main body M, a thermosetting adhesive or resin primer is preferably applied to the flush joint portion 10*b* and/or the raw FRP part P(Fr). The raw FRP part P(Fr) is applied to the main body M to cover the opening Op. At the time of applying the raw FRP part P(Fr), it is possible that the main body M is already put in the lower piece 20*b* of the mold 20 as its holder. By using a through hole 22, a bladder B inserted in the hollow (i) of the main body M is inflated with a high pressure fluid. At the same time, the mold 20 is heated. Thus, during heated the outside of the raw FRP part P(Fr) is pressed against the molding face C as the inside of the raw FRP part is pressurized by the inflated bladder B. As a result, the peripheral portion of the cured molded FRP part Fr is fusion-bonded with the flush joint portion 10*b* of the main body M. Thereafter, the bladder B is deflated and taken out from the hollow using the hole 22.

The above-mentioned through hole 22 in this example is provided in the side portion 6. Thus, the hole 22 is closed by a patch or plate with a trade name, ornamental design or the like. Aside from the side portion 6, the hole 22 can be provided in another portion. For example, it may be formed even in the bottom of the hosel.

By using a woven prepreg piece 11C, disarrangement of the fibers in the unidirectional prepreg 11A, 11B caused during pressurizing by the inflating bladder can be effectively prevented. Also the disarrangement during handling can be prevented. Thus, a single woven prepreg piece 11C can be placed on the outside or inside or both sides of the unidirectional prepreg pieces 11A and 11B. Further, it may be possible to dispose a plurality of woven prepreg pieces 11C on at least one side (for example outside) of the unidirectional prepreg pieces 11A and 11B.

Figure 3:
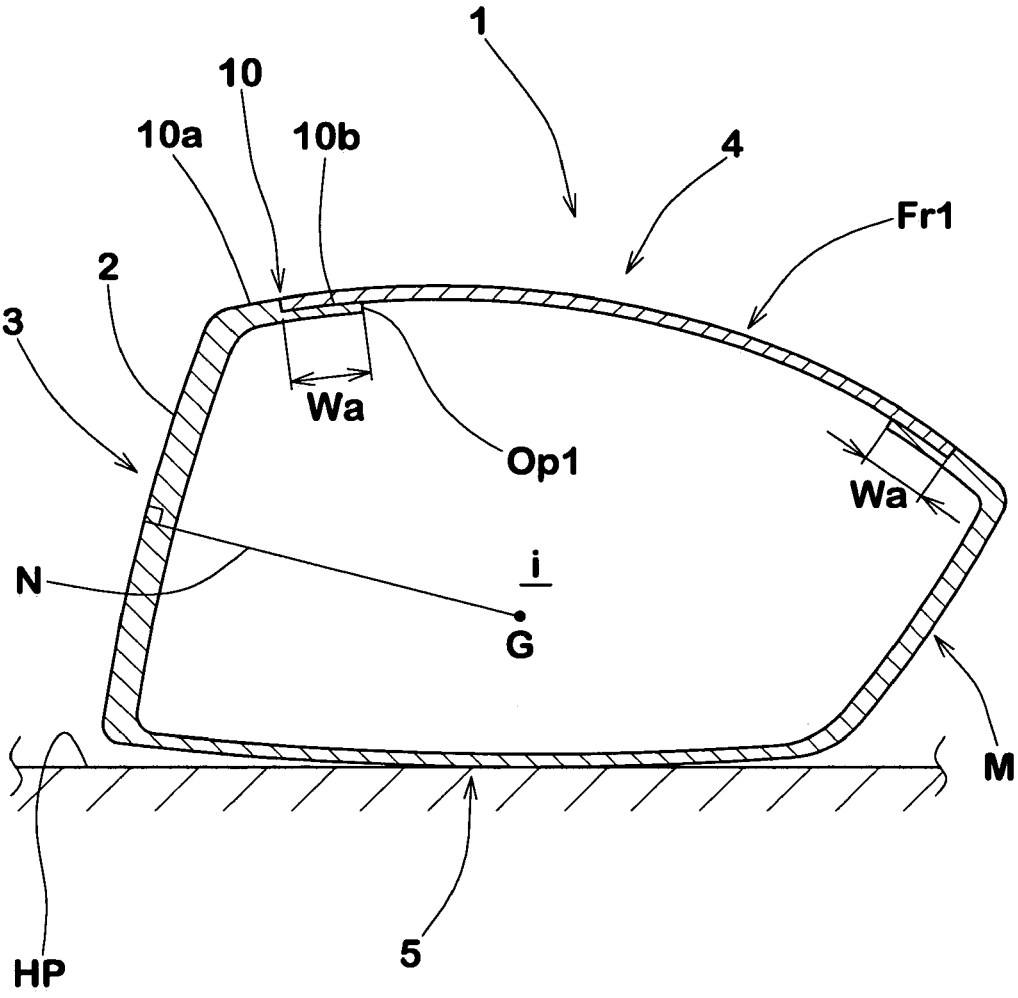
FIG. 3 is a cross-sectional view taken along a line A—A in FIG. 2.

It is preferable that the FRP part Fr is convexly curved in the cross section parallel to the front-back direction as shown in FIG. 3 because such a curvature induces an initial flexure which is effective on the improvement of the rebound performance. On the other hand, in the cross section parallel to the toe-heel direction, it may be almost straight or convexly curved with a larger radius RT than the radius RL in the cross section parallel to the front-back direction. For the same reason, it is also preferable that as shown in FIG. 7, the number of the traversal fiber plies 12B on the outside of the longitudinal fiber ply 12A is more than the number of the traversal fiber ply(ies) 12B on the inside of the longitudinal fiber ply 12A. This is because if reversed, the matrix resin is increased on the inside and resists compressive stress at impact. As a result, the FRP part Fr becomes rigid and it is difficult to improve the rebound performance.

In the above explained embodiments, as the curve of the FRP part Fr is slight in the crown portion, the fiber orientation directions or angles are substantially not altered when the viewpoint is moved. To be exact, however, the angle is defined as of the fibers projected on a horizontal plane HP. In other words, the angle is defined as viewed from the top as shown in FIG. 2 or viewed from the bottom as shown in FIG. 6.

In view of the improvement in the rebound performance and also lowering of the center of gravity, it is desirable to provide a larger opening Op1 in the crown portion 4 near the face portion 3. This however, requires a decrease in the width Wa of the flush joint portion 10*b*, and accordingly the joint strength is liable to become insufficient.

Figure 11:
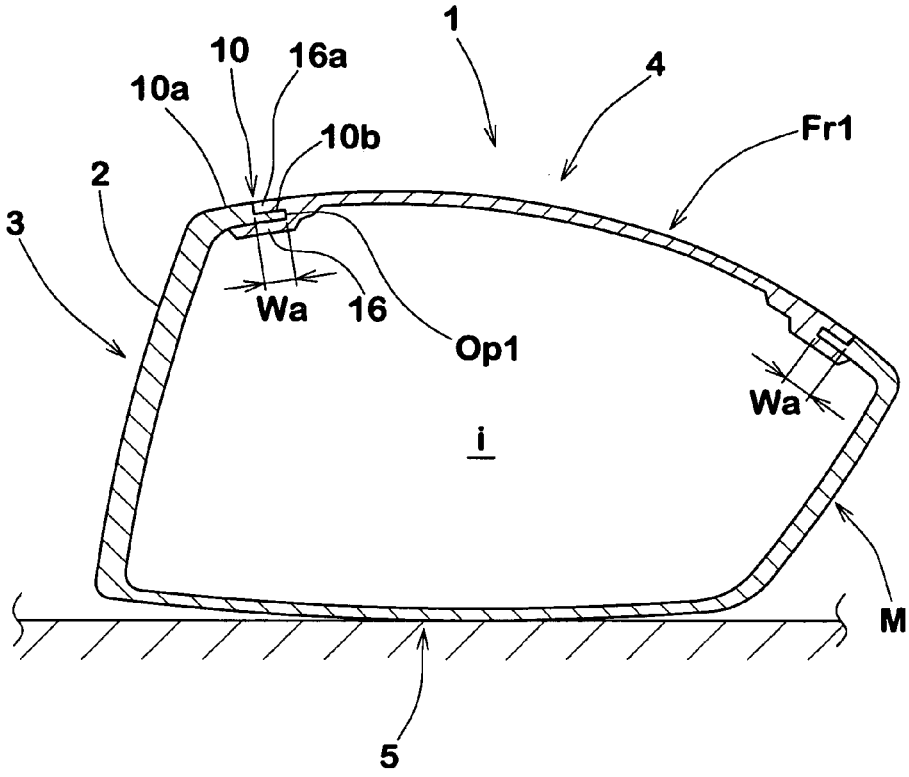
FIG. 11 is a cross sectional view of a modification of the golf club head shown in FIG. 3.
Figure 12A:
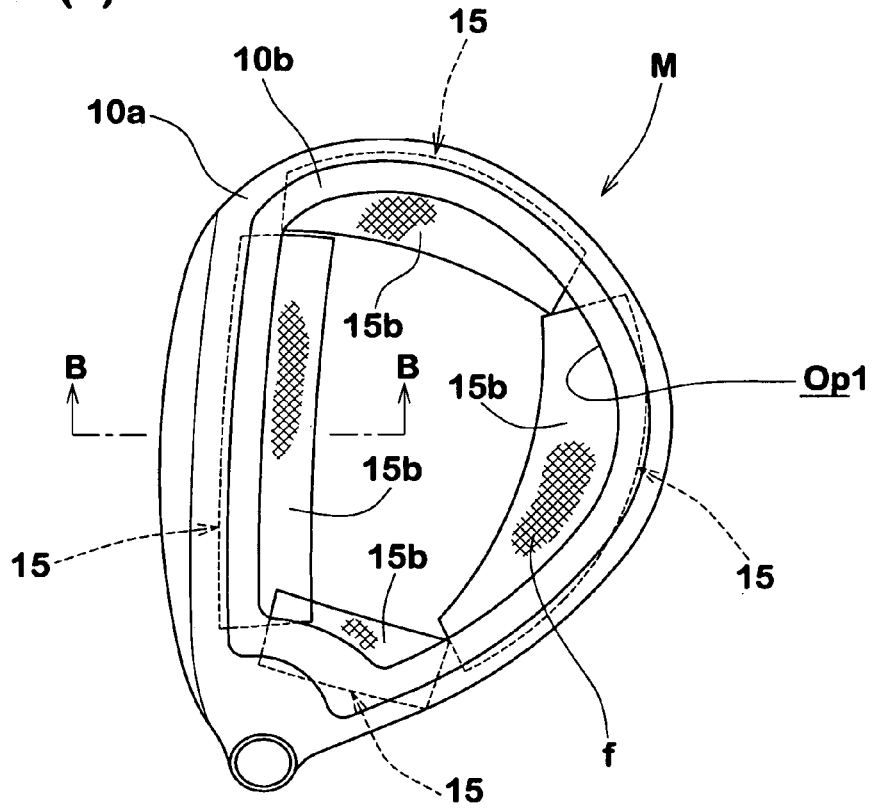
FIGS. 12(*a*), 12(*b*), 12(*c*) and 12(*d*) are a plan view of the main body and enlarged cross sectional views showing a method of manufacturing the golf club head shown in FIG. 11.
Figure 12B:
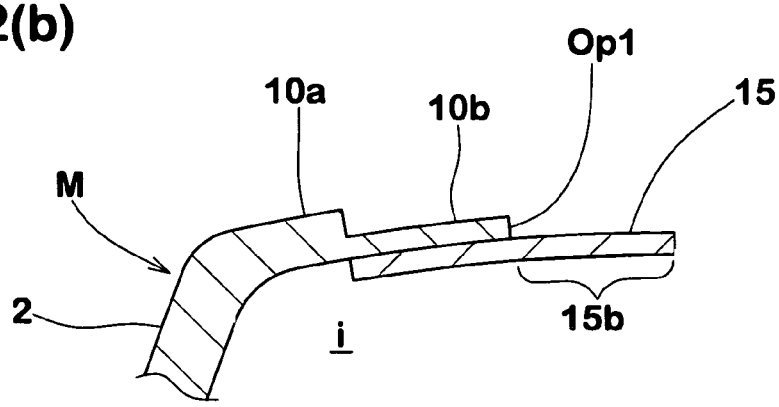
Figure 12C:
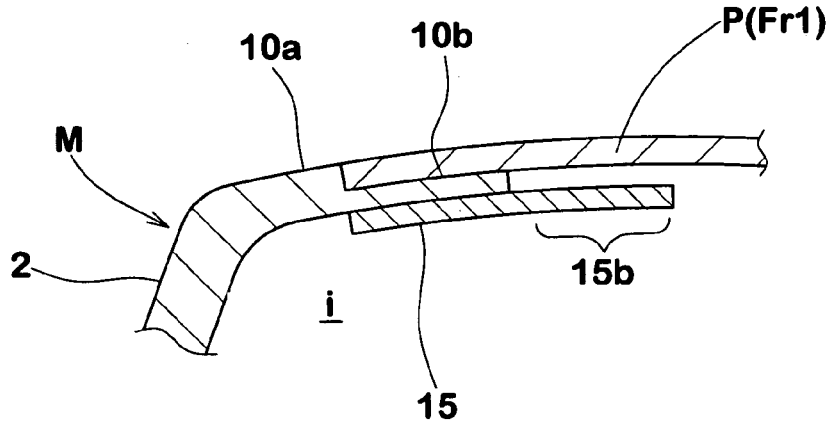
Figure 12D:
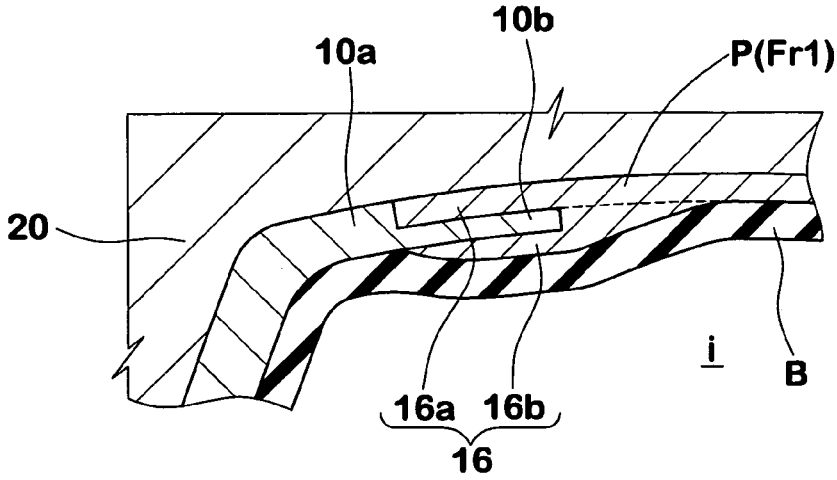

In such a case, as shown in FIG. 11 the FRP part Fr is provided with an additional inner portion 16*b* which extends along the inside of the flush joint portion 10*b* whereby the joint portion 10*b* is secured between the two-forked portion 16. Thus, the joint strength is greatly increased even if the width Wa is small.

Such additional inner portion 16*b* can be formed as shown in FIGS. 12(*a*), 12(*b*), 12(*c*) and 12(*d*).

Figure 10A:
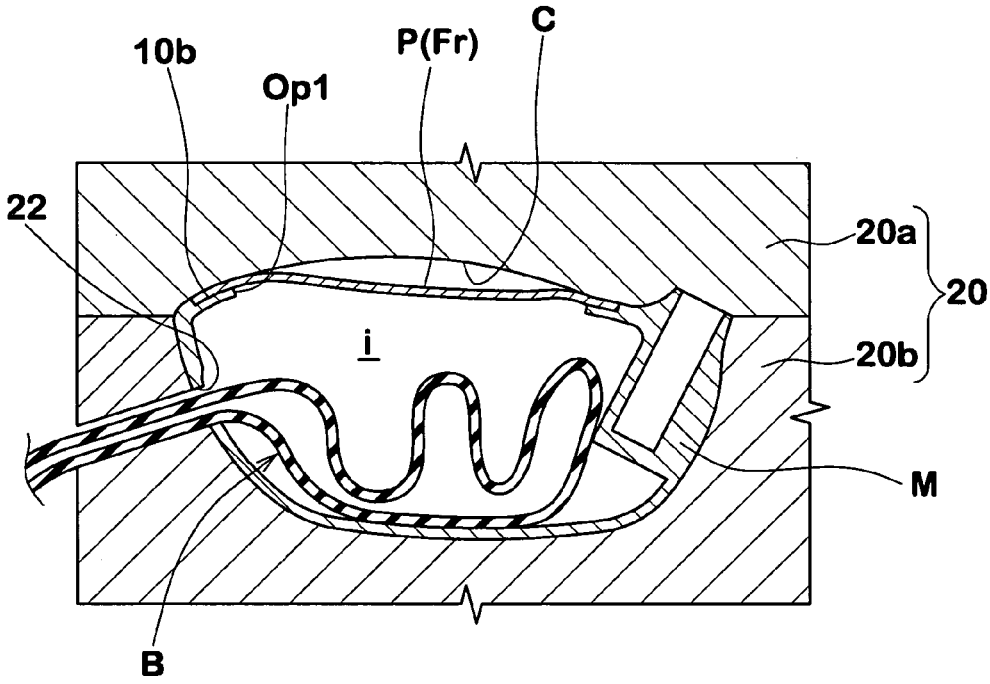
FIGS. 10(*a*) and 10(*b*) are cross sectional views for explaining a method of manufacturing the golf club head according to the present invention.
Figure 10B:
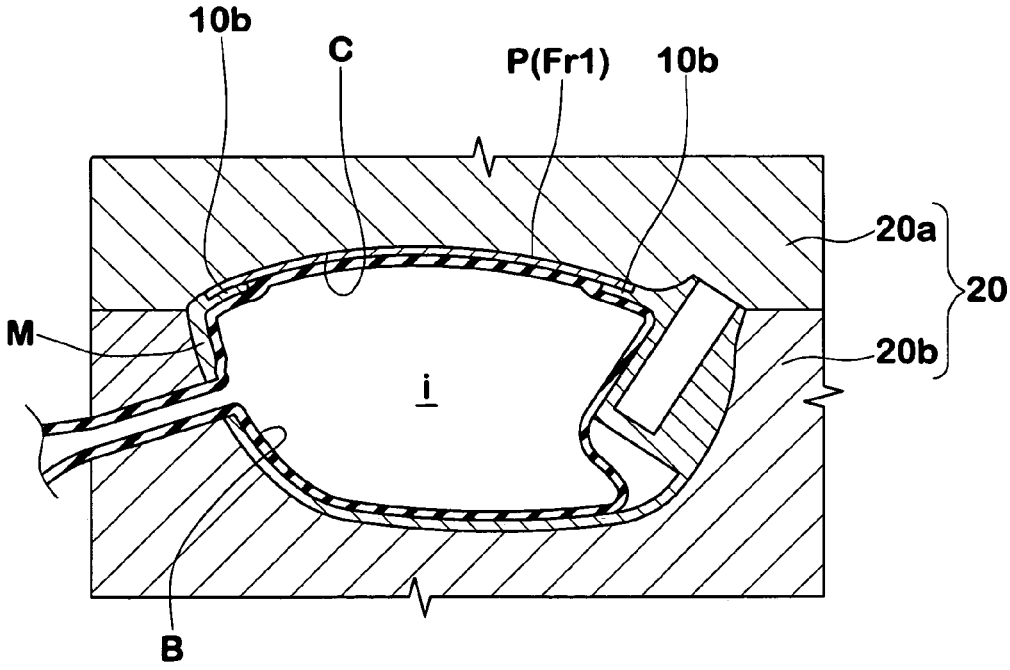

Before applying the raw FRP part P(Fr) to the main body M as shown in FIG. 10(*a*), a prepreg tape 15 is applied as shown in FIG. 12(*a*) to the inner surface of the flush joint portion 10*b* such that one longitudinal edge 15*b* protrudes into the opening Op1 as shown in FIG. 12(*b*). Then the raw FRP part P(Fr) is applied as shown in FIG. 12(*c*). The subsequent processes are the same as above. As a result, as shown in FIG. 12(*d*), the prepreg tape 15 and the raw FRP part P(Fr) are fused and tightly fixed to each other to form the above-mentioned two-forked portion 16.

As the additional inner portion 16*b* can be formed where necessary, the prepreg tape 15 can be applied partially. However, in view of the joint strength, it is desirable to apply the tape along the entire length of the edge of the opening Op1.

The prepreg tape 15 is required to be flexible so as to closely contact with the joint portion 10*b* and the raw FRP part P(Fr) during the inflation of the bladder B. Therefore, the tensile modulus of elasticity of the fibers (f) thereof is set at a relatively small value in the range of not more than 245 GPa, preferably less than 200 GPa, more preferably less than 150 GPa, but not less than 50 GPa. Further, the fibers (f) are preferably bidirectionally (crosswise directions) oriented at an angle in the range of about 30 to 60 degrees with respect to the front-back direction BL.

When the opening Op1 in the crown portion is provided, but the opening Op2 is not provided, the flexure in the front-back direction at impact becomes larger in the crown portion than the sole portion. Thus, the face portion tends to lean backward at impact and as a result the dynamic loft angle is increased. If such effect is not needed, it is better to provide both the openings Op1 and Op2. When the opening Op1 within the crown portion and the opening Op2 within the sole portion are both provided, as the weight of the metal material shifts towards the side portion 6, it becomes possible to increase the above-mentioned horizontal moment of inertia of the head. Further, as the FRP parts are usually light in weight in comparison with metal parts, the use of a FRP part is advantageous to the weight saving and thus head design freedom.

Comparison Tests:

Golf club heads for #1 wood having a volume of 420 cc were made and tested for the rebound performance and durability.

The heads had the same structure shown in FIGS. 1 to 4 except for the FRP parts.

Figure 13A:
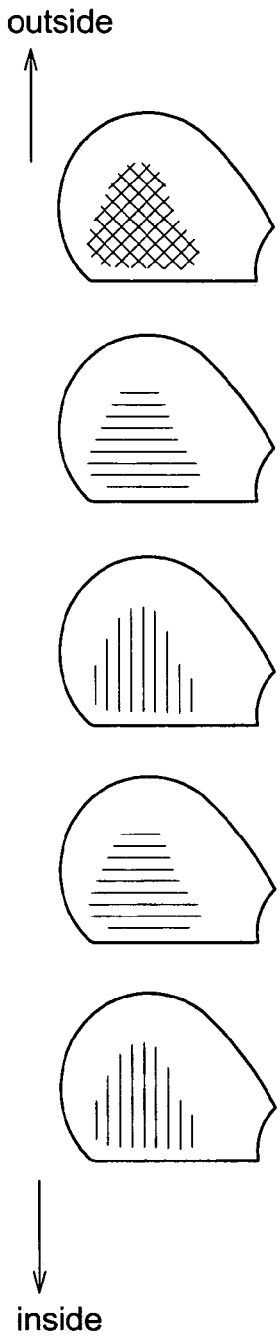
FIGS. 13(*a*), 13(*b*) and 13(*c*) show the arrangements of reinforcing fiber layers of golf club heads used in the undermentioned comparison tests.
Figure 13B:
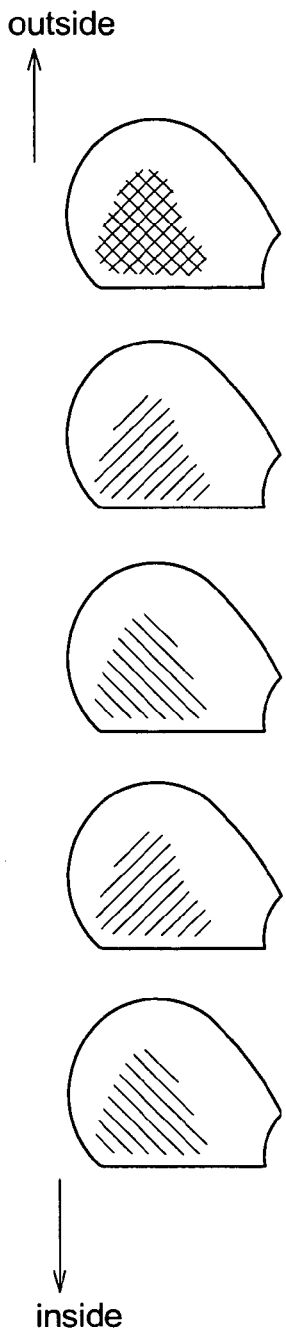
Figure 13C:
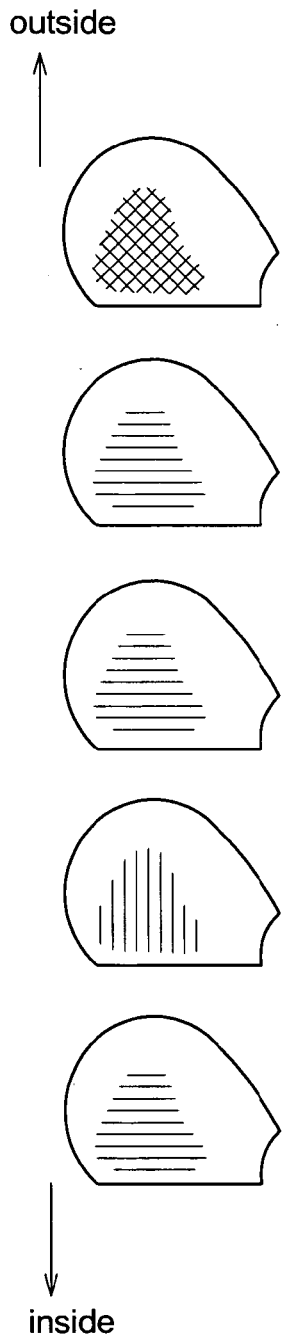

The FRP parts were made from carbon-fiber prepreg pieces as shown in FIGS. 13(*a*), 13(*b*) and 13(*c*). The specifications are shown in Table 1. The thickness of the FRP part in the finished head was 0.8 mm.

The main body was made by casting a titanium alloy Ti-6Al-4V, and then by utilizing a numerically controlled machine tool, a high-precision finishing was made on the opening Op1 and flush joint portion. The ratio (S1/S) of the area S1 of the opening Op1 to the area S encircled by the outline of the head was 0.7.

The Ex. 6 head was provided with the two-forked portion 16 shown in FIG. 11 according to the method described in connection with FIGS. 12(*a*)14 12(*d*), wherein a 20 mm-width tape 15 of unwoven bidirectional prepreg was applied so as to protrude about 10 mm as shown in FIG. 12(*a*).

Rebound Performance Test:

According to the "Procedure for Measuring the Velocity Ratio of a Club Head for Conformance to Rule 4-1e, Appendix II, Revision 2 (Feb. 8, 1999), United States Golf Association", the restitution coefficient of each club head was obtained. The larger the value, the better the rebound performance.

Durability Test:

Each club head was attached to a carbon shaft "MP-200 made by SRI Sports, Co., Ltd." to make a 45-inch wood club. Then, the golf club was attached to a swing robot "shotrobo-4 made by Miyamae Corporation" and hit golf balls again and again at a head speed of 51 m/s at the centroid of the face to count up the number of hits (Max.=5000 times) until a damage was observed in the head. The results are shown in Table 1.

From the test results it was confirmed that the rebound performance can be improved without deteriorating the durability.

The present invention can be suitably applied to wood-type heads such as driver and fairway wood having a hollow behind the face portion, but it is also possible to apply the invention to various club heads such as iron-type, utility-type and putter-type.

TABLE 1

| Head | Ref.1 | Ref.2 | Ex.1 | Ex.2 | Ex.3 | Ex.4 | Ex.5 | Ex.6 | Ex.7 | Ref.3 |
|---|---|---|---|---|---|---|---|---|---|---|
| Ply arrangement (Fig.) | 13(a) | 13(b) | 13(c) | 13(c) | 13(c) | — | 13(c) | 13(c) | 13(c) | — |
| Unidirectional ply or prepreg | | | | | | | | | | |
| Total number of plies | 4 | 4 | 4 | 4 | 4 | 3 | 4 | 4 | 4 | 3 |
| Orientation angle (deg.) | | | | | | | | | | |
| Innermost first ply | 0 | +45 | 90 | 90 | 90 | 90 | 90 | 90 | 90 | 90 |
| Second ply | 90 | −45 | 0 | 0 | 0 | 0 | 0 | 0 | 0 | 0 |
| Third ply | 0 | +45 | 90 | 90 | 90 | 90 | 90 | 90 | 90 | 0 |
| Fourth ply | 90 | −45 | 90 | 90 | 90 | — | 90 | 90 | 90 | — |
| E (GPa)/FAW (g/sq.m) *1 | | | | | | | | | | |
| 45 degree ply | — | 294/58 | — | — | — | — | — | — | — | — |
| 0 degree ply | 294/58 | 294/58 | 294/58 | 294/58 | 235/125 | 294/58 | 294/58 | 235/125 | 294/58 | 294/58 |
| 90 degree ply | 294/58 | 294/58 | 294/58 | 235/125 | 294/58 | 294/58 | 294/58 | 235/125 | 294/58 | 294/58 |
| Product GL | 34104 | — | 17052 | 17052 | 29375 | 17052 | 17052 | 29375 | 17052 | 34104 |
| Product GT | 34104 | — | 51156 | 88125 | 51156 | 34104 | 51156 | 88125 | 51156 | 17052 |
| GL/GT(=Gl/Gt) | 1.0 | — | 0.3 | 0.2 | 0.6 | 0.5 | 0.3 | 0.3 | 0.3 | 2.0 |
| Square woven ply or prepreg | | | | | | | | | | |
| Number of ply | 1 | 1 | 1 | 1 | 1 | 1 | 0 | 1 | 1 | 1 |
| Orientation angle (deg) | +45 & −45 | +45 & −45 | +45 & −45 | +45 & −45 | +45 & −45 | +45 & −45 | — | +45 & −45 | +45 & −45 | +45 & −45 |
| Two-forked portion 16 | non | non | non | non | non | non | non | non | provided | non |
| Restitution coefficient | 0.841 | 0.841 | 0.852 | 0.852 | 0.958 | 0.851 | 0.853 | 0.858 | 0.852 | 0.84 |
| Durability performance | 3450 | 3410 | 3400 | 3420 | 3420 | 2800 | 3100 | 3420 | 5000 (no damage) | 3400 |

*1) 294 GPa: Tread name "MR350C-050S" manufacture by Mitsubishi Rayon Co., Ltd. (Fiber areal weight = 58 gram/sq.m, Resin content = 25%) 235 GPa: Tread name "TRC350C-125S" manufactured by Mitsubishi Rayon Co., Ltd. (Fiber areal weight = 125 gram/sq.m, Resin content = 25%)

The invention claimed is:

1. A golf club head comprising a hollow main body made of at least one metal material and provided in at least one of a crown portion and a sole portion of the head with an opening, and an FRP part covering said opening and made of at least one resinous material reinforced with fibers, wherein said fibers include longitudinal fibers oriented in a direction substantially parallel to the front-back direction of the head, and traversal fibers oriented in a direction substantially perpendicular to the front-back direction, and the longitudinal fibers are less than the traversal fibers with respect to a total weight of fibers in a unit area.

2. A golf club head comprising a hollow main body made of at least one metal material and provided in at least one of a crown portion and a sole portion of the head with an opening, and an FRP part covering said opening and made of at least one resinous material reinforced with fibers, wherein said fibers include longitudinal fibers oriented in a direction substantially parallel to the front-back direction of the head, and traversal fibers oriented in a direction substantially perpendicular to the front-back direction, and the longitudinal fibers are less than the traversal fibers with respect to a total of tensile elastic moduli of fibers in a unit area.

3. A golf club head comprising a hollow main body made of at least one metal material and provided in at least one of a crown portion and a sole portion of the head with an opening, and an FRP part covering said opening and made of at least one resinous material reinforced with fibers, wherein said fibers include longitudinal fibers oriented in a direction substantially parallel to the front-back direction of the head, and traversal fibers oriented in a direction substantially perpendicular to the front-back direction, and the longitudinal fibers are less than the traversal fibers with respect to a product of a total weight of fibers in a unit area and an average tensile elastic moduli of the fibers.

4. A golf club head according to claim 1, 2 or 3, wherein said fibers has a layered structure, wherein the traversal fibers forms at least two layers, and the longitudinal fibers forms at least one layer the number of which is less than that of the traversal fibers, and the layer of the longitudinal fibers is sandwiched between the layers of the traversal fibers.

5. A golf club head according to claim 4, wherein said fibers further include square-woven fibers as the outermost layer of said layered structure.

6. A golf club head according to claim 5, wherein said fibers further include square-woven fibers as the innermost layer of said layered structure.

7. A golf club head according to claim 1, 2 or 3, wherein said fibers further include at least one layer of woven fibers.

* * * * *